United States Patent [19]

Yamagishi

[11] Patent Number: 4,742,887

[45] Date of Patent: May 10, 1988

[54] OPEN-AIR TYPE EARPHONE

[75] Inventor: Makoto Yamagishi, Tokyo, Japan

[73] Assignee: Sony Corporation, Tokyo, Japan

[21] Appl. No.: 13,939

[22] Filed: Feb. 12, 1987

[30] Foreign Application Priority Data

Feb. 28, 1986 [JP] Japan ..... 61-28490[U]

[51] Int. Cl.[4] ..... H04R 25/00

[52] U.S. Cl. ..... 181/129; 181/160; 381/68; 381/69; 381/154; 381/158; 381/159; 381/187

[58] Field of Search ..... 181/130, 132, 160, 129; 381/68.6, 153, 154, 156, 159, 160, 169, 187, 205, 68, 69, 158

[56] References Cited

U.S. PATENT DOCUMENTS 3,246,721 4/1966 Martin ..... 381/153 X 4,239,945 12/1980 Atoji et al. ..... 381/187 X 4,637,489 1/1987 Iwanaka et al. ..... 181/160

*Primary Examiner*—B. R. Fuller

*Attorney, Agent, or Firm*—Lewis H. Eslinger

[57] ABSTRACT

An earphone has a housing divided by a driver unit into front and back cavities with a sound generation opening at the front thereof, a duct extending from the back cavity of the housing and having a length substantially larger than its diameter, and a casing attached to the housing and communicating with the back cavity through a pipe having a length longer than its diameter, with the resonant frequency determined by the casing and pipe being made near to the resonant frequency determined by the equivalent mass of the vibration system, that is, the diaphragm and voice coil of the driver unit, and by the compliance of the back cavity, so that the lowest resonant frequency of the earphone can be lowered while the peak that would otherwise be formed in the frequency characteristic of the earphone by the resonance between the back cavity and mass of the vibration system can be supressed for improving the high frequency characteristic.

4 Claims, 6 Drawing Sheets

OPEN-AIR TYPE EARPHONE

BACKGROUND OF THE INVENTION

1. Field of the Invention

This invention relates generally to earphones, and, more particularly, is directed to improving the acoustic characteristics of open-air type earphones in the low and high frequency ranges.

2. Description of the Prior Art

Open-air type earphones according to the prior art have a housing with a driver unit therein comprising a magnetic circuit and a vibration system constituted by a diaphragm and voice coil. In such open-air type earphones, the response decreases at frequencies below the resonant frequency of the vibration system and, therefore, the resonant frequency needs to have a low value in order to improve the low frequency characteristic. In order to reduce the resonant frequency, it is necessary to increase the compliance and/or the equivalent mass of the vibration system. In order to increase the compliance of the vibration system, it is necessary to select a material for the diaphragm having a high compliance, and to decrease the thickness of the diaphragm. However, there are limits to the compliance of the material that can be used for the diaphragm and the extent to which the thickness of the diaphragm can be reduced is also limited. Further, increasing the equivalent mass of the vibration system causes deterioration of the sensitivity and the acoustic characteristic of the earphone in the high frequency range.

In order to avoid the above problems, the present applicant has earlier proposed, for example, as disclosed in Japanese Utility Model application No. 71055/1983, which was the subject of Japanese Utility Model unexamined publication No. 177287/1984, that an in-the-ear earphone or headphone be provided with a duct extending from the housing in back of the driver unit so that, when the earphone is situated in the ear, the duct projects out of the concha. The duct is formed to provide an equivalent mass added to the equivalent mass and compliance of the vibration system so that the resonant frequency is lowered in correspondence to the added equivalent mass of the duct. Therefore, the resonant frequency can be lowered irrespective of the compliance and equivalent mass of the vibration system with the result that the characteristic of the earphone in the low frequency range can be improved. However, such improvement of the characteristic in the low frequency range requires that there be a significant acoustic resistance in parallel with the equivalent mass of the duct, for example, by providing acoustic resistance material in an opening or openings formed in the housing in back of the driver unit. However, in that case, a resonant circuit is formed by the mass of the vibration system and the compliance of the housing in back of the driver unit which is in parallel with the mentioned acoustic resistance. As a result of such resonance circuit, a peak appears in the frequency characteristic of the earphone at frequencies of 3 to 5 kHz, that is, a part of the high frequency range is emphasized, so that metallic sounds become overly conspicuous and unpleasant to hear. In other words, when the low frequency range of the earphone is extended, an undesirable peak occurs in the high frequency range and, conversely, when it is attempted to suppress such peak, the reproducible low frequency range cannot be extended.

OBJECTS AND SUMMARY OF THE INVENTION

Accordingly, it is an object of this invention to provide an earphone having an extended reproducible low frequency range, and in which any resulting peak in the high frequency range is effectively suppressed.

More specifically, it is an object of this invention to provide an earphone having a housing containing a driver unit and provided with a sound generation opening in front of the driver unit, and a duct extending from the housing behind the driver unit for reducing the lowest resonant frequency, particularly when the acoustic resistance of the housing in back of the driver unit is increased, and further in which the resulting extension of the reproducible low frequency range is not accompanied by an undesirable emphasis or peak in the high frequency range.

In accordance with an aspect of this invention, an earphone comprises a driver unit, a housing containing the driver unit and having a sound generation opening in the front thereof, a duct extending from the housing behind the driver unit and communicating with the interior of the housing, such duct having a length substantially larger than its diameter, and a casing attached to the housing behind the driver unit and communicating with the interior of the housing through a pipe having a length longer than the diameter of the pipe. In the foregoing arrangement according to this invention, the resonant frequency of a resonant circuit constituted by an equivalent mass formed by the pipe and a compliance formed by the casing is made to be near to a resonant frequency which is determined by a mass of the vibration system included in the driver unit and a compliance of the housing in back of the driver unit, so as to suppress the relatively high frequency peak which would otherwise result from the resonance of the housing in back of the driver unit and the mass of the vibration system.

The above, and other objects, features and advantages of the invention, will become apparent when the following detailed description is read in connection with the accompanying drawings in which corresponding parts and elements are identified by the same reference numerals in the several views.

DESCRIPTION OF THE PREFERRED EMBODIMENTS

Figure 1:
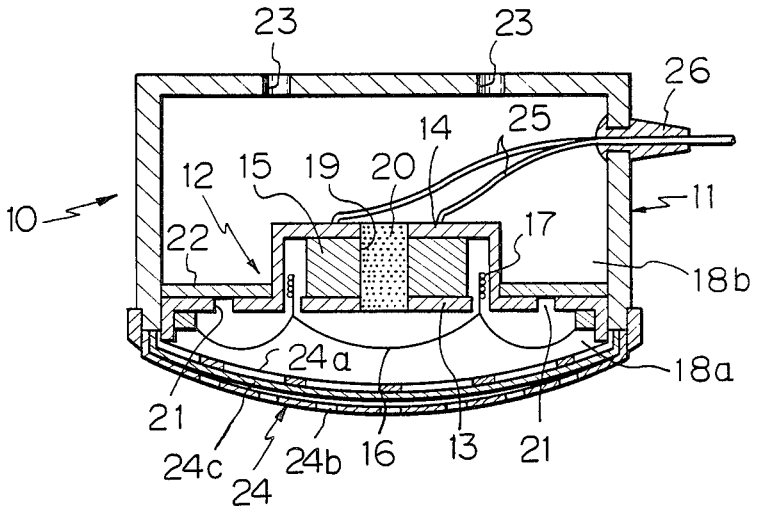
Fig. 1 PRIOR ART
FIG. 1 is a cross-sectional view showing an example of an earphone according to the prior art.

In order that the problems to be overcome by the present invention may be fully understood, reference will first be made to FIG. 1 which shows an open-air type earphone 10 according to the prior art. Earphone 10 is shown to comprise a housing 11 containing a driver unit 12. The driver unit 12 includes a magnetic circuit formed by a magnetic plate 13, a yoke 14 and a magnet 15, and a vibration system formed of a diaphragm 16 and a voice coil 17 which is accommodated in a gap between yoke 14 and magnet 15. Driver unit 12 extends across housing 11 adjacent a sound generation opening at the front of the housing so as to divide the interior of the housing into a front cavity 18*a* and a back cavity 18*b*. A hole 19 extends through the center of driver unit 12, and acoustic resistance material 20, for example, of urethane or the like, is embedded in hole 19. A plurality of holes 21 extend through plate 13 of driver unit 12 and are covered by acoustic resistance material 22. A plurality of holes 23 are formed in the back of housing 11 and the back cavity 18*b* communicates freely through such holes 23 with the surrounding atmosphere. A protective cover 24 extends across the sound generation opening at the front of housing 11 for preventing damage to diaphragm 16 and may be formed of an inner punched metal sheet 24*a* having relatively large holes therein, an outer punched metal sheet 24*b* having relatively small holes therein and a cloth sheet 24*c* intermediate metal sheets 24*a* and 24*b* for preventing the entry of dust and like. Lead wires 25 extend from driver unit 12 and are led out of housing 11 through a bushing or grommet 26 situated in a suitable hole formed in the side of housing 11.

Figure 2:
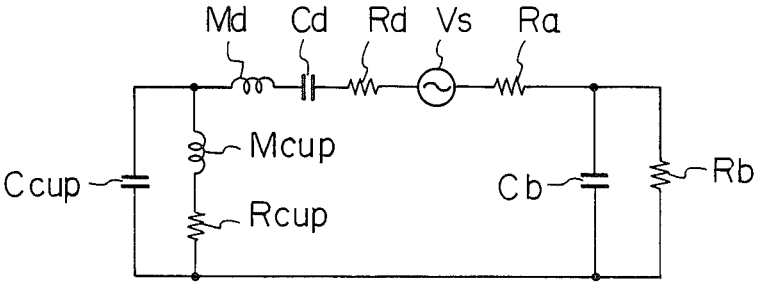
Fig. 2 PRIOR ART
FIG. 2 is an equivalent circuit diagram corresponding to the earphone of FIG. 1.

An acoustic operating circuit of the open-air type earphone 10 described above with reference to FIG. 1 can be expressed by the equivalent circuit shown in FIG. 2. More particularly, the vibration system of driver unit 12 is represented by the series circuit of an equivalent mass $M_d$, a compliance $C_d$ and an acoustic resistance $R_d$. A force to effect forward and backward movement of diaphragm 16 is represented by a voltage source $V_s$, and $R_a$ is the acoustic resistance to the passage of sounds through the acoustic resistance material 20 in hole 19 and through the acoustic resistance material 22 covering holes 21 in driver unit 12. In the equivalent circuit of FIG. 2, the back acoustic system is represented by a parallel circuit of a compliance $C_b$ and an acoustic resistance $R_b$ of back cavity 18*b*. Further, in FIG. 2, the compliance, equivalent mass, and acoustic resistance of an external ear hole into which the earphone 10 is inserted are represented at $C_{cup}$, $M_{cup}$ and $R_{cup}$, respectively.

Since no resistance material covers or otherwise interferes with the passage of sound through the holes 23 in the back of housing 11, the acoustic resistance $R_b$ of the back cavity 18*b* is so small that it can be ignored in comparison with the acoustic resistance $R_a$. Similarly, the compliance $C_b$ of the back cavity 18*b* can also be ignored because of the existence of the uncovered holes 23. Therefore, the equivalent circuit in FIG. 2 can be regarded as a series resonance circuit consisting of the equivalent mass $M_d$, compliance $C_d$ and acoustic resistances $R_d$ and $R_a$ of the vibration system. Thus, the resonant frequency $f_o$ can be expressed as below:

$$f_0 = 1/(2\pi\sqrt{Md\ Cd}) \quad (1)$$

In the open-air type earphone according to the prior art as shown on FIG. 1, the response decreases at frequencies below the resonant frequency $f_0$ of the vibration system. Therefore, it is desirable that the resonant frequency $f_0$ be made as small as possible in order to improve the low frequency characteristic. As is apparent from equation (1) the resonant frequency $f_0$ may be decreased by increasing the compliance $C_d$ and/or the equivalent mass $M_d$ of the vibration system. In order to increase the compliance $C_d$ of the vibration system, it is necessary to select a material of high compliance for the diaphragm 16 and/or to decrease the thickness of the diaphragm. However, there are limits to the compliance of the materials that can be used for the diaphragm and the extent to which the thickness of the diaphragm 16 can be reduced is also limited. Further, increasing the equivalent mass $M_d$ of the vibration system causes deterioration of the sensitivity and acoustic characteristic of the earphone 10 in the high-frequency range.

Figure 3:
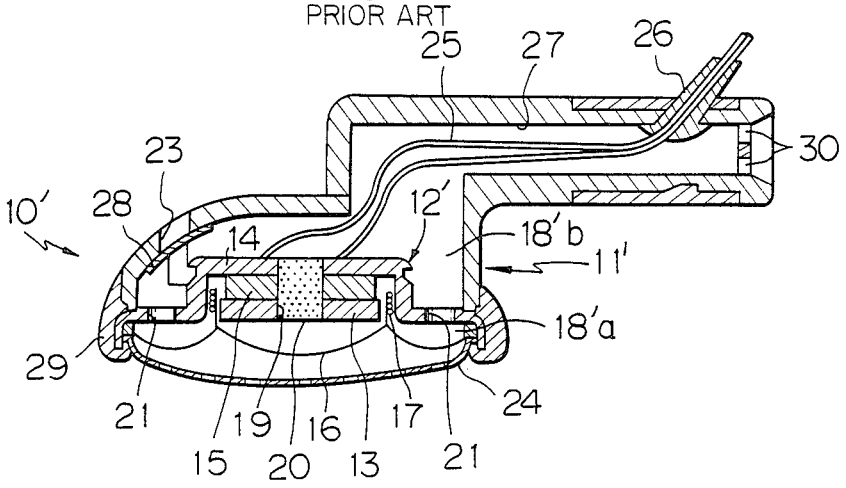
Fig. 3 PRIOR ART
FIG. 3 is a cross-sectional view showing another example of an earphone according to the prior art.
Figure 4:
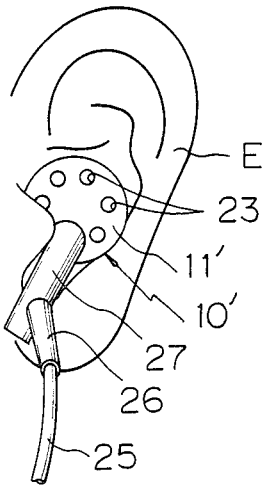
Fig. 4 PRIOR ART
FIG. 4 is a diagrammatic perspective view showing the mounting of the earphone of FIG. 3 in the ear of a user.

Referring now to FIG. 3, it will be seen that, in order to avoid the above problems, the present applicant has earlier proposed in Japanese Utility Model unexamined publication No. 177287/1984, identified more fully above, to provide an earphone 10' with a duct 27 extending from housing 11' and communicating with the back cavity 18'*b* of the housing. As shown in FIG. 4, the earphone 10' is intended to be inserted in the external ear E of the user in such a manner that a terminal portion of duct 27 projects outwardly from the concha. Those parts of the earphone 10' which are similar to parts of the earphone 10 previously described with reference to FIG. 1 are identified by the same reference numerals and the detailed description thereof will not repeated.

It will be noted that, in the earphone 10', the holes or openings 21 in plate 13 are uncovered, that is, the acoustic resistance material 22 on FIG. 1 is omitted, so that the acoustic resistance $R_a$ is substantially zero. However, an acoustic resistance material 28 is applied to each of the holes or openings 23 at the substantially frusto-conical back of housing 11' so that the acoustic resistance $R_b$ is thereby set to a sufficient value for a reason hereinafter described in detail.

An elastic ring 29 of rubber or the like is provided around the sound generating opening at the front of housing 11' for preventing leakage of sound between plate 13 and housing 11' and between plate 13 and protective cover 24. Openings 30 are provided in the end portion of duct 27 remote from housing 11'. The duct 27 has a length substantially larger than its diameter, for example, a length of 12 mm. and a diameter of 2.2 mm., in which case the duct 27 can be represented by an equivalent mass $M_{duct}$ added to the series circuit of the equivalent mass $M_d$, compliance $C_d$ and acoustic resistances $R_d$ and $R_a$ of the vibration system. Therefore, the resonant frequency $f_0$ is reduced by an amount corresponding to the added equivalent mass $M_{duct}$. Such reduction of the resonant frequency $f_0$ is achieved irrespective of the compliance $C_d$ and equivalent mass $M_d$ of the vibration system for improving the characteristic of the earphone in the low-frequency range.

Figure 6:
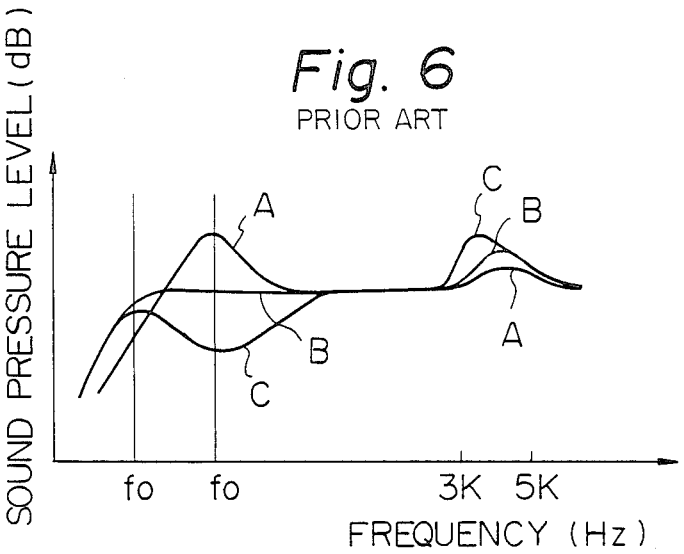
Fig. 6 PRIOR ART
FIG. 6 is a graph showing characteristic curves for earphones according to the prior art.

It is to be noted that the lowest resonant frequency $f_0$ of the earphone 10' can be reduced by providing the duct 27, as described above, only if the acoustic resistance $R_b$ which is in parallel with the equivalent mass $M_{duct}$ of the duct 27, is substantially greater than zero. In other words, in order to substantially realize the affect of the equivalent mass $M_{duct}$, the acoustic resistance $R_b$ needs to be increased by the provision of acoustic resistance material 28 over openings 23. For example, as shown on FIG. 6, as the acoustic resistance $R_b$ is increased by suitably changing the material, thickness or the like of the acoustic resistance material 28 associated with openings 23, the characteristic curve of the earphone changes, as indicated by the curves A,B and C. However, when the acoustic resistance $R_b$ is increased, a resonance circuit is formed by the compliance $C_b$, which is in parallel with the acoustic resistance $R_b$, and the mass $M_d$ of the vibration system. As a result of such resonance circuit, a peak appears in the frequency characteristic of the earphone at frequencies of 3 to 5 kHz, that is, a part of the high-frequency range is emphasized, as shown on FIG. 6, so that metallic sounds become overly conspicuous and unpleasant to hear. Thus, in the case of the earphone according to the prior art shown on FIG. 3, as the low frequency range of the earphone is extended downwardly, an undesirable peak occurs in the high frequency range, whereas, when such peak is suppressed, the reproducible low-frequency range cannot be extended.

Figure 7:
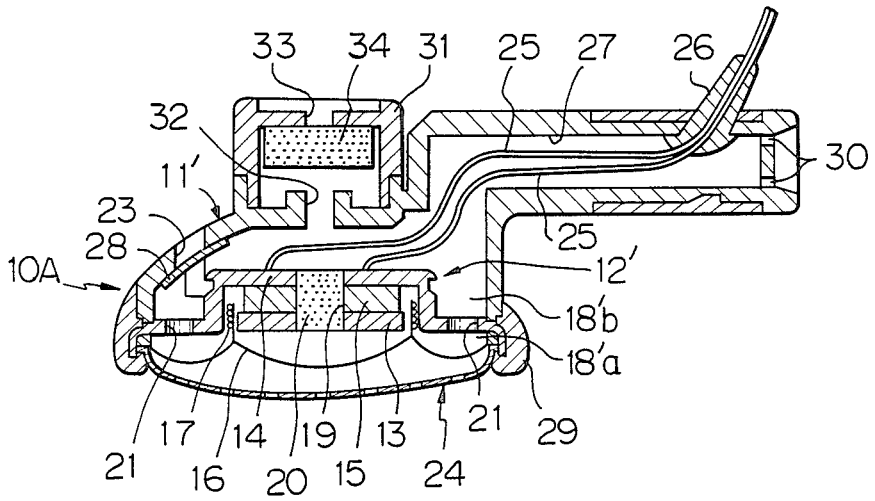
FIG. 7 is a cross-sectional view showing an earphone according to a first embodiment of the present invention.

Referring now to FIG. 7, it will be seen that an earphone 10A according to an embodiment of the present invention is generally similar to the earphone 10' described above with reference to FIG. 3 and has its corresponding parts identified by the same reference numerals. As before, the housing 11' has an approximately frusto-conical back portion and, in the case of the earphone 10A, an approximately cylindrical casing 31 is suitably attached at the center of such frusto-conical back portion of casing 11'. The casing 31 and the back cavity 18'b of housing 11' communicate with each other through a pipe 32 which extends centrally into casing 31. An opening 33 is provided through the center of the back wall of casing 31, and an acoustic resistance material 34, for example, urethane or the like, extends across such opening 33.

In a practical example of the earphone 10A according to the present invention, the magnet 15 of driver unit 12' is formed of samarium cobalt, and the diaphragm 16 is of a polyethylene film having a thickness of 6 μm. The duct 27 has a diameter of 2.2 mm. and a length of 12 mm., while the pipe 32 also has a length longer than its diameter, for example, a length of 1.5 mm., and a diameter of 1 mm. Finally, casing 31 is provided with an internal volume of 70 $mm^3$.

Figure 5:
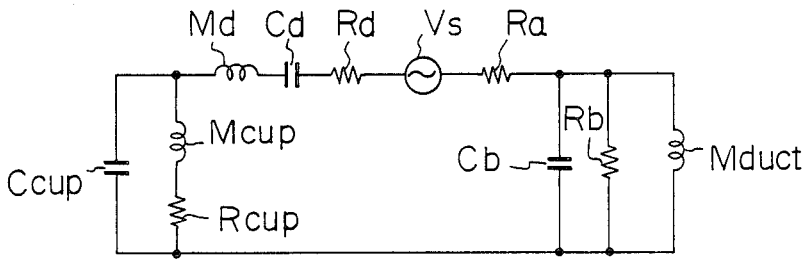
Fig. 5 PRIOR ART
FIG. 5 is an equivalent circuit diagram corresponding to the earphone of FIG. 3.
Figure 8:
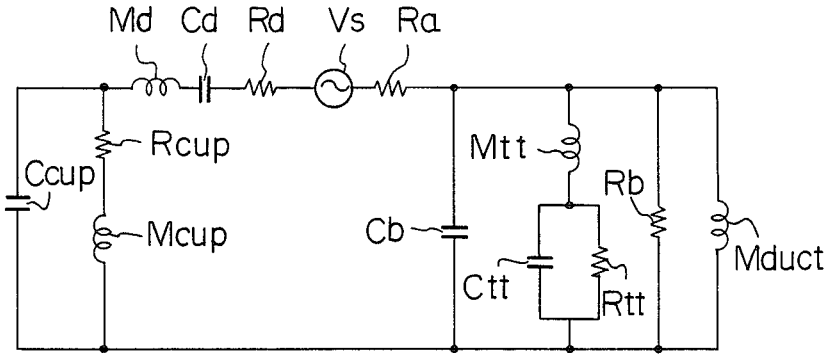
FIG. 8 is an equivalent circuit diagram corresponding to the earphone of FIG. 7.

Referring now to FIG. 8, it will be seen that the acoustic equivalent circuit for the earphone 10A according to the invention differs from that shown on FIG. 5 for the prior art earphone 10' by the addition thereto of an equivalent mass $M_{tt}$, a compliance $C_{tt}$ and an acoustic resistance $R_{tt}$ corresponding to the pipe 32, casing 31 and opening 33, respectively. In FIG. 8, as in FIG. 5, the equivalent mass $M_{duct}$ of the duct 27 is added to the series circuit consisting of the equivalent mass $M_d$, compliance $C_d$ and acoustic resistance $R_d$ of the vibration system so that the lowest resonant frequency $f_0$ is decreased in accordance with the amount of the added equivalent mass $M_{duct}$. Such lowering of the lowest resonant frequency $f_0$ by the added equivalent mass $M_{duct}$ is made possible by the substantial value of the acoustic resistance $R_b$ resulting from the acoustic resistance material 28 covering openings 23. However, by reason of the equivalent mass $M_{tt}$ formed by pipe 32, the compliance $C_{tt}$ formed by casing 31 and the acoustic resistance $R_{tt}$ formed by the opening 33 covered by acoustic resistance material 34, the peak that would otherwise be caused in the frequency range of 3 to 5 kHz by the resonance between equivalent mass $M_d$ of the vibration system and compliance $C_b$ of the back cavity 18'b is suppressed.

More specifically, a resonance circuit is formed by the equivalent mass $M_{tt}$ of pipe 32 and the compliance $C_{tt}$ of casing 31. Therefore, the impedance across the circuit consisting of equivalent mass $M_{tt}$, compliance $C_{tt}$ and acoustic resistance $R_{tt}$ decreases at the resonant frequency of such resonance circuit. Thus, by selecting the resonant frequency of the resonance circuit formed by equivalent mass $M_{tt}$ and compliance $C_{tt}$ to be a value near to the resonant frequency of the circit comprised of the equivalent mass $M_d$ of the vibration system and the compliance $C_b$ of back cavity 18'b, the peak that would otherwise be caused by equivalent mass $M_d$ and compliance $C_b$ in the frequency range of 3 to 5 kHz can be suitably suppressed.

Figure 9:
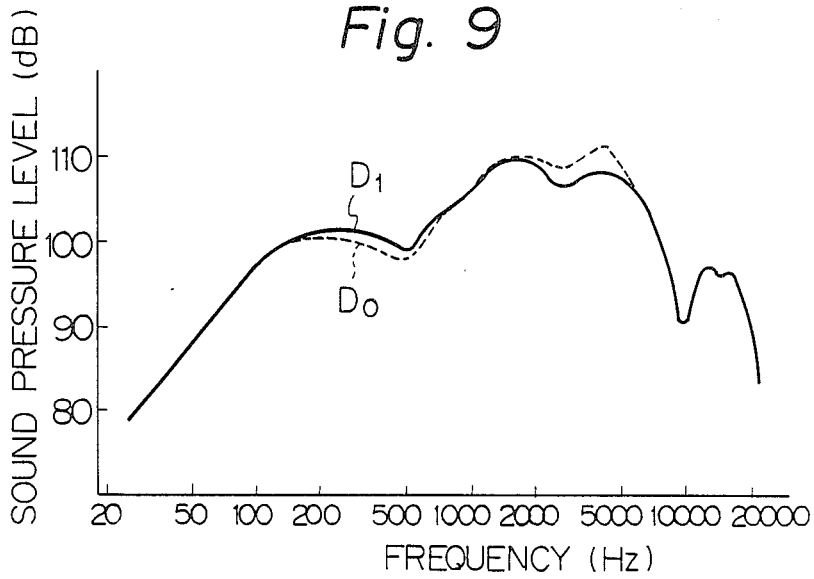
FIGS. 9. and 10 are graphs showing frequency characteristics of earphones according to the invention as compared with earphones according to the prior art.

As will be apparent from FIG. 9, in which the curve $D_1$ in solid lines represents the frequency characteristic for the earphone 10A embodying the present invention and the curve $D_0$ in broken lines represents the frequency characteristic of the earphone 10' according to the prior art as illustrated on FIG. 3, the peak appearing in the frequency range of 3 to 5 kHz for the earphone according to the prior art is substantially suppressed in the case of the earphone 10A according to the invention. The curves $D_0$ and $D_1$ on FIG. 9 represent the frequency characteristics for the earphones 10' and 10A, respectively, provided that such earphones 10' and 10A having substantially the same values of the acoustic resistance $R_b$.

However, if desired, the acoustic resistance $R_b$ of the earphone 10A according to this invention may be substantially increased relative to the acoustic resistance $R_b$ for the earphone 10' according to the prior art, thereby to further decrease the lowest resonant frequency $f_0$ of the earphone 10A embodying the invention without increasing the peak in the frequency range of 3 to 5 kHz beyond that occurring in the frequency characteristic of the earphone 10' according to the prior art. Thus, for example, in FIG. 10, the curve $D_2$ indicates the frequency characteristic of an earphone according to the present invention in which the acoustic resistance $R_b$ has been increased beyond the corresponding acoustic resistance $R_b$ of the earphone 10' according to the prior art shown in FIG. 3 and having the frequency characteristic represented by the curve $D_0$. It will be apparent from a comparison of curves $D_0$ and $D_2$ that, if the peaks in the frequency range of 3 to 5 kHz are permitted to be nearly equal for the earphones according to the invention and according to the prior art, respectively, the lowest resonant frequency $f_0$ can be made lower for the earphone according to the present invention than for the earphone according to the prior art, for example, 100 Hz as compared with 150 Hz.

Figure 11:
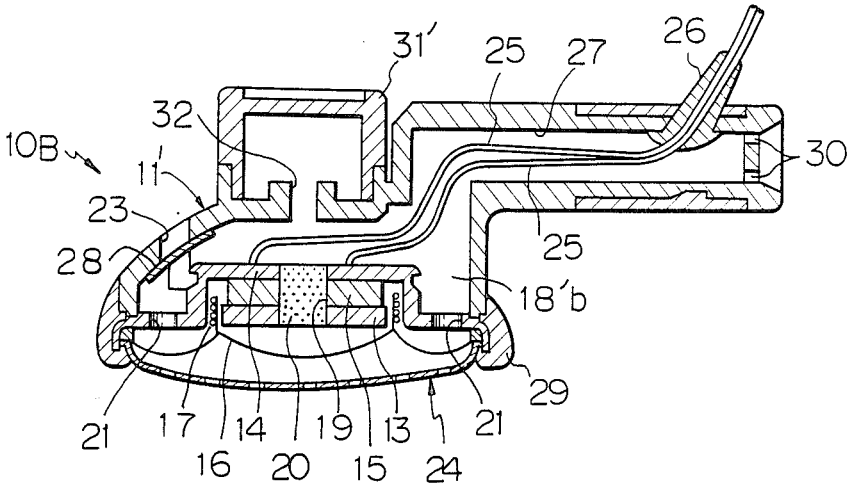
FIG. 11 is a cross-sectional view showing an earphone according to a second embodiment of the invention.

Although FIG. 7 shows the invention embodied in an earphone in which the casing 31 has an opening or hole 33 in the back thereof covered by acoustic resistance material 34, it is to be understood that the invention may also be embodied in an earphone 10B as shown on FIG. 11 and in which the casing 31' defines a closed chamber communicating only with the back cavity 18'b of housing 11' through the pipe 32. Apart from the foregoing, that is, apart from the omission of the hole 33 and acoustic resistance material 34 from casing 31', the earphone 10B is substantially similar to the earphone 10A and has its several parts identified by the same reference numerals.

Figure 10:
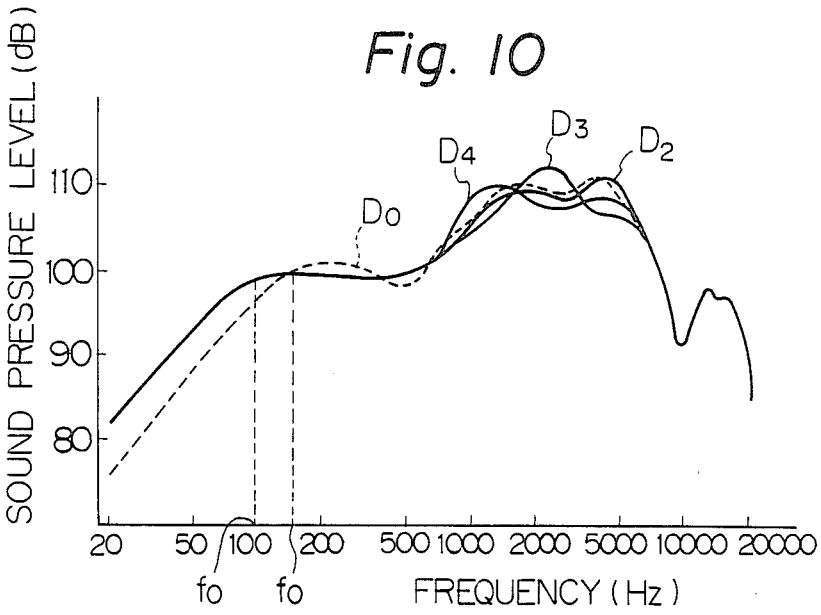

In the case of the earphone 10B shown on FIG. 11, when the volume of casing 31' is 70 $mm^3$., and the value of the acoustic resistance $R_b$ is increased similarly to that in the earphone represented by the curve $D_2$ on FIG. 10, the frequency characteristic of the earphone is represented by the curve $D_3$. In other words, removal of the hole or opening 33 from the casing 31 of earphone 10A has the effect of shifting the peak from the frequency range of 3 to 5 kHz to a frequency near 2 kHz. Such shifting of the peak in the frequency characteristic tends to make the metallic sounds less conspicuous. If the volume of the casing 31' in earphone 10B is increased to 300 $mm^3$., the frequency characteristic becomes that indicated by the curve $D_4$ on FIG. 10. In such case, the peak is less pronounced and the frequency characteristic is somewhat flattened. However, the casing 31' is undesirably enlarged in order to provide the same with a volume of 300 $mm^3$.

Although the invention has been described above in its application to earphones of the in-the-ear type which are positioned near the inlet of the external acoustic meatus, it will be appreciated that the invention can be similarly applied to closed-type earphones. Further, the desirable effects of the invention are particularly obtained when the invention is applied to stereophonic earphones which are associated with both the right and left ears of the listener.

By way of summary, it will be noted that the resonance circuit consisting of the equivalent mass $M_{tt}$ formed by pipe 32 and the compliance $C_{tt}$ formed by casing 31 or 31' has its resonance frequency set to a value near the resonance frequency of the compliance $C_b$ of the back cavity 18'b and the mass $M_d$ of the vibration system. By reason of the foregoing, the peak in the frequency characteristic caused by the resonance between the back cavity and the mass of the vibration system is relatively suppressed. Thus, the high frequency characteristic can be improved and the acoustic resistance $R_b$ can be increased for reducing the lowest resonant frequency $f_0$.

Although preferred embodiments of the invention have been described with detail herein with reference to the accompanying drawings, it is to be understood that the invention is not limited to those precise embodiments, and that various changes and modifications may be effected therein by one skilled in the art without departing from the spirit or scope of the invention as defined in the appended claims.

What is claimed is:

1. An open-air type earphone comprising:

a driver unit including means defining a magnetic circuit, and a diaphragm, and voice coil which form a vibration system:

a housing containing said driver unit and having a sound generation opening to the atmosphere in front of said driver unit, and at least another opening to the atmosphere from said housing behind said driver unit and which has acoustic resistance material extending thereacross;

an elongated duct extending from said housing behind said driver unit and communicating, at one end, with the interior of said housing and, at its other end, with the atmosphere to provide an equivalent mass which is in parallel with an acoustic resistance of said acoustic resistance material and which is effective for reducing the lowest resonance frequency of the earphone;

a casing attached to said housing behind said driver unit; and means defining a pipe communicating, at its ends, with said housing and said casing, respectively, and having a diameter and a length longer than said diameter of the pipe, a resonant frequency of a resonant circuit constituted by an equivalent mass formed by said pipe and a compliance formed by said casing being selected to be near to a resonant frequency which is determined by a mass of said vibration system and a compliance of said housing in back of said driver unit as to suppress a relatively high frequency peak that would otherwise be formed in the frequency characteristic of the earphone by said reducing of the lowest resonance frequency of the earphone.

2. An open-air type earphone according to claim 1; wherein said casing has an opening to the atmosphere, and said opening of the casing has acoustic resistance material extending thereacross.

3. An open-air type earphone according to claim 1; wherein said casing defines a closed chamber communicating only with said housing through said pipe.

4. An open-air type earphone according to claim 1, wherein said magnetic circuit includes a plate extending across said housing and dividing the latter into a back cavity and a front cacity communicating with said second generation opening, a magnet and a yoke, said diaphragm extends across said housing in said front cavity and said plate of the driver unit has unobstructed holes therethrough for communicating said front and back cavities.

* * * * *